US006325347B1

(12) United States Patent
Crichton

(10) Patent No.: US 6,325,347 B1
(45) Date of Patent: Dec. 4, 2001

(54) MOUNTING BRACKET ASSEMBLY FOR ELECTRIFIED TAPE

(75) Inventor: John P. Crichton, Cary, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/599,233

(22) Filed: Jun. 22, 2000

(51) Int. Cl.[7] ..... A47B 96/06

(52) U.S. Cl. ..... 248/228.1; 248/228.3; 256/54

(58) Field of Search ..... 248/228.1, 228.3, 248/227.3, 227.4, 219.4, 219.1, 228.5, 228.6; 256/3, 54, 68

(56) References Cited

U.S. PATENT DOCUMENTS 1,630,441 * 5/1927 Lotz ..... 256/3
2,437,344 * 3/1948 Behlmann ..... 174/163
2,893,677 * 7/1959 Dannenburg ..... 248/228
3,124,330 * 3/1964 Robinson ..... 248/228
3,217,833 * 11/1965 Smith ..... 182/3
3,348,362 * 10/1967 Swager ..... 182/230
3,533,587 * 10/1970 Vecchiarelli et al. ..... 248/228
3,652,780 * 3/1972 Wilson ..... 174/45 R
3,715,991 * 2/1973 Boyd ..... 104/23 R
4,052,028 * 10/1977 Cordero, Jr. ..... 248/228

* cited by examiner

*Primary Examiner*—Ramon O. Ramirez
*Assistant Examiner*—A. Joseph Wuyciak
(74) *Attorney, Agent, or Firm*—Banner & Witcoff, Ltd.

(57) ABSTRACT

A mounting bracket assembly for a conductive electrified tape used for fence enclosures by attachment to a T-cross sectional steel fence post which includes a non-conductive bracket held by clamps on the post and further includes metal loops which secure the tape in a desired orientation.

3 Claims, 3 Drawing Sheets

MOUNTING BRACKET ASSEMBLY FOR ELECTRIFIED TAPE

BACKGROUND OF THE INVENTION

In a principal aspect the present invention relates to a mounting bracket assembly for attachment of conductive or electrified tape used for fence enclosures to a T-cross section, steel fence post.

Enclosures for livestock or to protect property may comprise an electrified fence arrangement. The use of electrified wire strands or barbed wire as a fencing material is often discouraged inasmuch as the wire fencing material may injure the animals retained within the enclosure. Also, such wire may be difficult to observe visually. Thus, especially with animals such as horses which are susceptible to such injury caused by a wire or fencing that is not readily seen, a practice has developed to use electrified fence tape. Typically, the tape is made from a plastic material which is non-conductive. Small conductive wires are woven through the tape. The tape may have a width of 1 to 5 inches. The small conductive wires being woven throughout the tape along its length are connected to a current source and may provide an electric shock. A typical tape is disclosed in U.S. Pat. Nos. 4,728,080 and 4,905,969 incorporated herewith by reference.

Such tapes may be supported on various types of fence posts. It is important, however, to make sure that the posts are not electrically connected to the tape or that the posts are made from an insulating material. Otherwise, the electric current is grounded and the fence becomes totally ineffective.

T-cross section steel fence posts are desirable and common in the environment where such conductive fences are likely to be utilized. Such T-shaped cross section fence posts have been used for many decades in combination with wire, including wire fencing and barbed wire. It has also become desirable to use such fence posts for the erection of electric fences utilizing conductive tape fencing material. However, because the steel posts are conductive, proper attachment of the tape and support thereof by a post becomes an important factor in the construction of a fence. It is important, for example, to somehow insulate the conductive tape from the post. Such insulation can occur by coating the post with a non-conductive material, for example. Various other schemes can be utilized. Nonetheless, there has remained a need to provide a method for supporting a conductive tape material on a steel T-cross section fence post efficiently and economically. Such demands inspired the development of the present invention.

SUMMARY OF THE INVENTION

Briefly, the present invention comprises a mounting bracket assembly for conductive electrified tape used for the construction of a fence enclosure wherein the tape is attached to and supported by a T-cross section fence post. The bracket assembly includes a bracket made from a non-conductive or insulating material. The bracket is attached to the fence post by means of clamp members. The bracket includes spaced outwardly projecting arms and a connecting rod extending between the arms. The connecting rod supports closed loops through which electrified or conductive tape may be passed for support. In this manner, the non-conductive bracket insulates the conductive tape from the steel post thereby enabling speedy erection of an electrified fence even in the event the closed tape support loops are made from a conductive material.

Thus, it is an object of the invention to provide an improved bracket assembly for attachment of and support of a conductive tape on a steel T-cross section fence post.

A further object of the invention is to provide a bracket assembly which is easy to attach to a steel T-cross section fence post, which provides excellent insulating qualities, and which can be easily removed and replaced as necessary.

Yet a further object of the invention is to provide an inexpensive, yet rugged bracket assembly for attaching conductive tape to a fence post.

These and other objects, advantages and features of the invention will be set forth in the detailed description which follows.

DESCRIPTION OF THE PREFERRED EMBODIMENT

Figure 1:
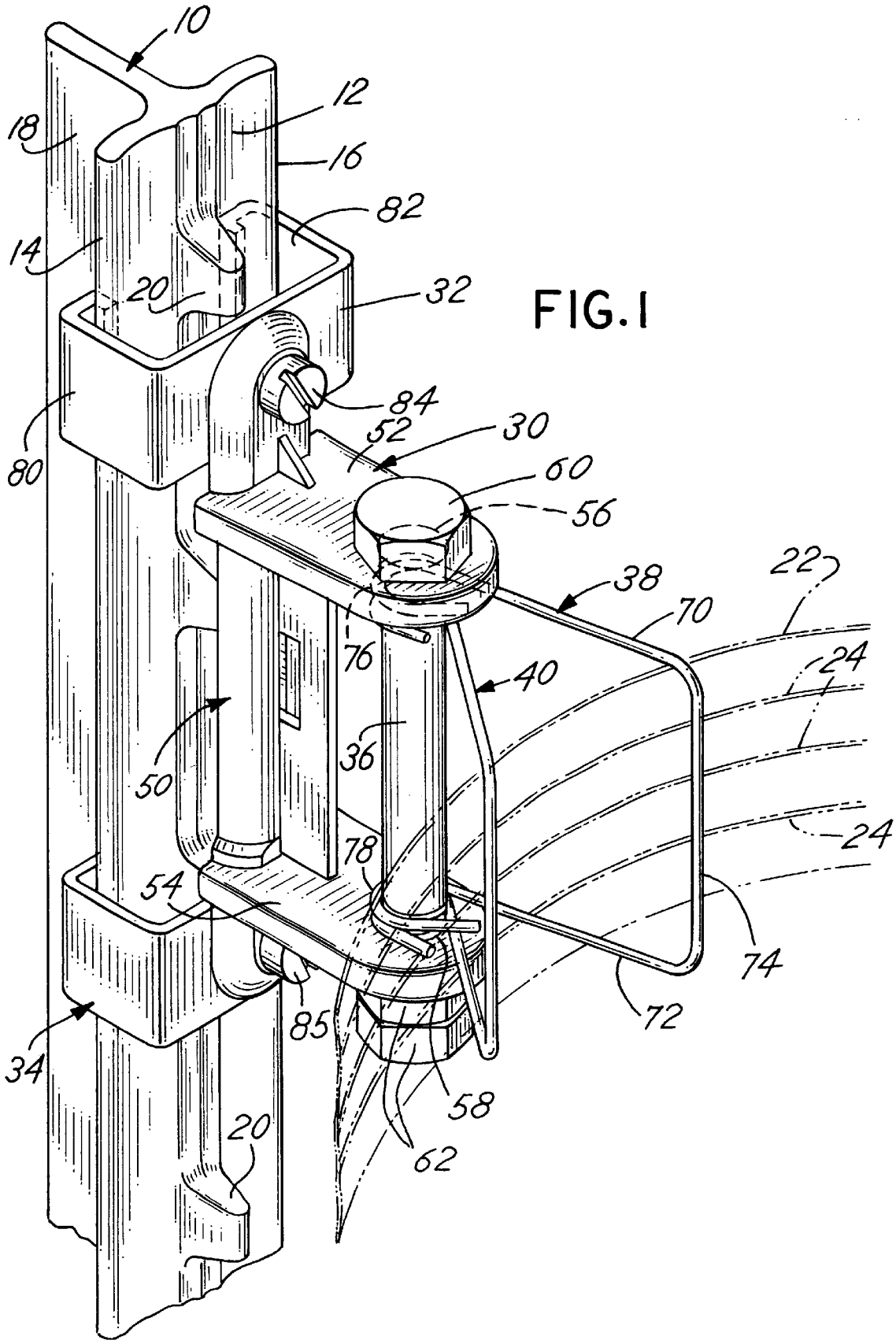
FIG. 1 is an isometric view of the mounting bracket assembly of the invention in combination with a T-cross section fence post and a conductive tape.
Figure 2:
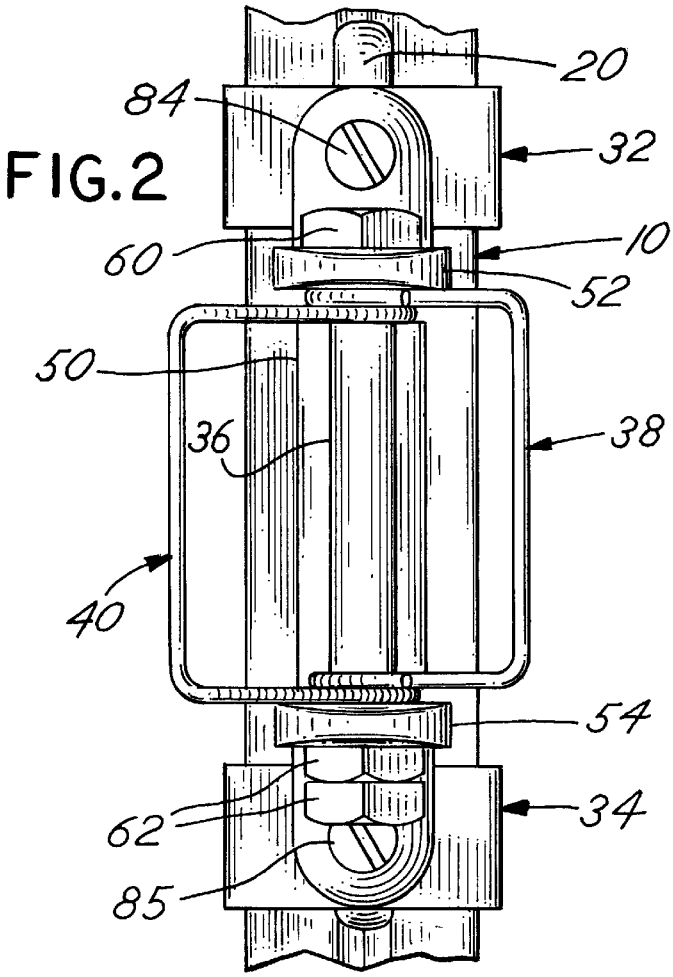
FIG. 2 is a front elevation of the bracket assembly of FIG. 1.
Figure 3:
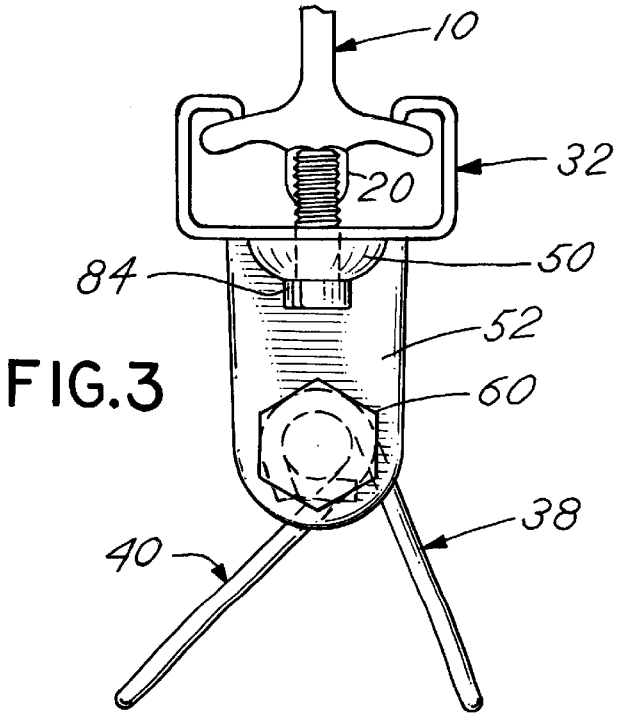
FIG. 3 is a top plan view of the bracket assembly of FIG. 1.
Figure 4:
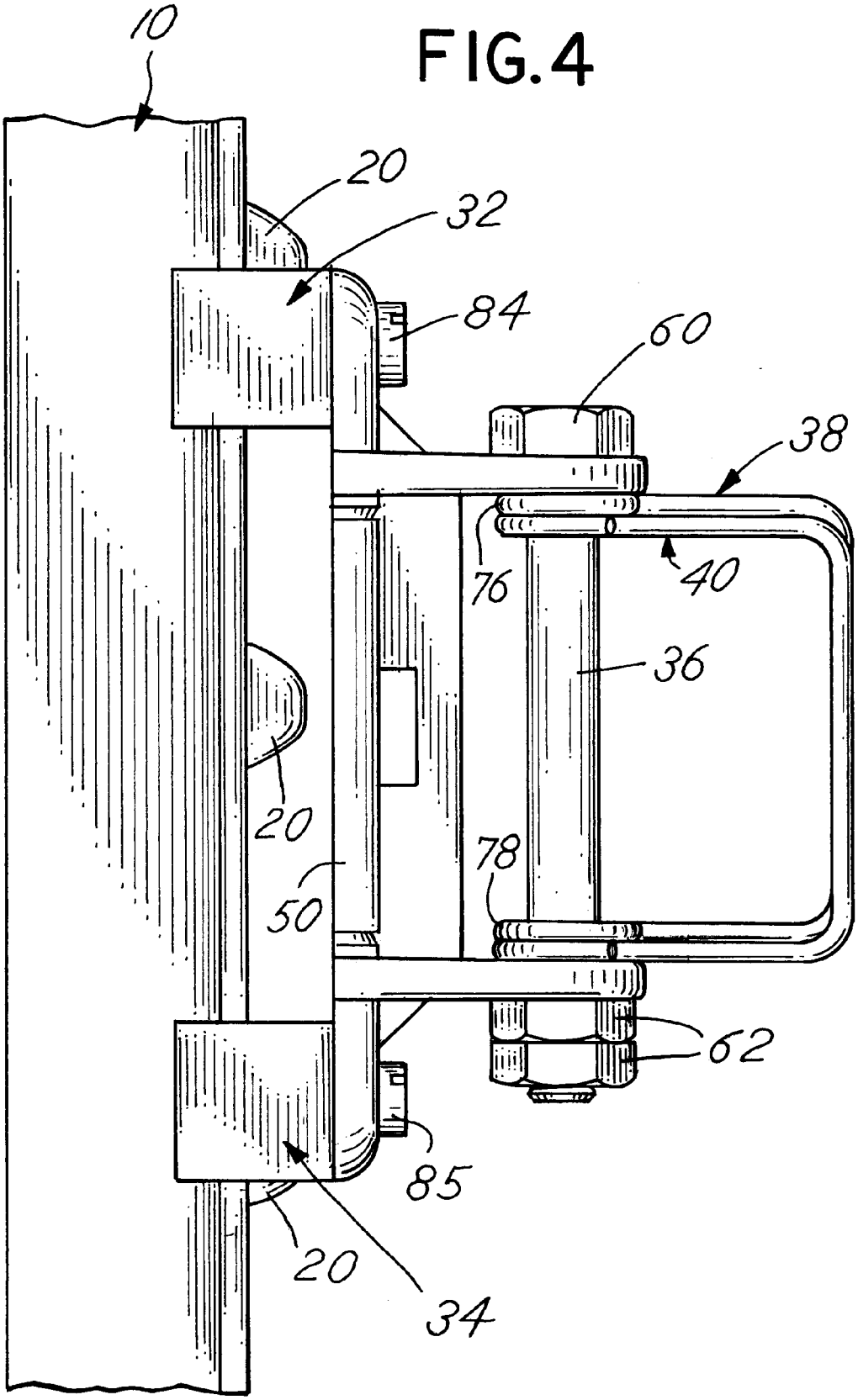
FIG. 4 is a side elevation of the bracket assembly of FIG. 1.

Referring to the figures, and in particular FIG. 1, there is disclosed a typical T-shaped steel fence post 10. The steel post 10 includes a flange 12 having opposed wings, sides or edges 14 and 16. A center reinforcing rib 18 extends the length of the post 10. Typically, such a post 10 also includes projecting support ribs 20 along the vertical length of the post on the flange 12 on the opposite side from the rib 18. Such steel fence posts are driven from their top downwardly into soil to provide a support for fencing of various types.

The fencing material which is utilized with the bracket assembly of the present invention comprises an elastomeric tape 22 which typically includes conductive wires 24 through the length thereof. The tape 22, and more particularly, the wires 24, are attached to an electric or current source. The tape 22 when assembled to a fence post 10 then acts as an electrified fencing enclosure.

The bracket assembly of the present invention comprises a means for attaching the tape 22 to the fence post 10 and for insulating the tape 22 electrically from the post 10. The bracket assembly includes a bracket 30 formed from a non-conductive material such as plastic or a ceramic in combination with a first clamp 32 and a second clamp 34. A rod 36 which may be conductive or non-conductive is supported by the bracket 30 and, in turn, supports a first loop 38 and a second loop 40. The loops 38 and 40 are in the form of generally rectangular closed loops in combination with the rod 36. The tape 22 may then be passed through one or both of the loops 38, 40 and supported by the bracket assembly while being insulated from the post 10.

The non-conductive bracket 30 includes a vertical support bar 50 with integrally molded support arms including a first support arm 52 and a second support arm 54 projecting laterally therefrom. The arms 52 and 54 are parallel to one another and spaced from one another. The arms 52 and 54 are preferably made from the same materials and are integral with the vertical bar 50. The rod 36 passes through openings 56 and 58 in the arms 52 and 54, respectively. Fasteners 60 and 62 retain the rod 36 on the arms 52 and 54. The loops

38 and 40 are each formed from wire rod, for example, and each include spaced horizontal runs such as runs 70 and 72 of loop 38 with a connecting horizontal run 74. The runs 70, 72 and 74 terminate with circular formed ends 76 and 78 by way of example which surround the rod 36 and permit rotation of the loop 38 about the axis defined by the rod 36 to accommodate differing angles of connection of the tape 22. Both loops 38 and 40 are movable in the manner described.

The bracket 30 is attached to the post 10 by means of the first clamp 32 and second clamp 34. Each clamp, for example clamp 32, includes a first clamp arm 80 and a second clamp arm 82 which fit over the flange 12. A threaded fastener 84 fits through the bar 50 and the clamp 32 to engage against the flange 12 and compress or hold the arms 80 and 82 tightly against the flange 12. Thus, the threaded fastener 84 associated with first clamp 32 and a threaded fastener 85 associated with the second clamp 34 together tightly attach and hold the bracket 30 on the post 10.

Adjusting the position of the bracket assembly involves releasing the fasteners 84 and 85 so as to position the clamps 32 and 34 in a desired fashion. In this manner, the bracket assembly may be adjusted vertically on the post 10. Adjustment of the loops 38 and 40 permits appropriate alignment thereof so as to engage the tape 22. The bracket assembly of the invention is especially useful at corner posts inasmuch as the loops 38 and 40 facilitate movement or turning of a tape through a corner. Note that the tape 22 may be folded over the loops and engage therewith in the manner of a belt buckle type connection. In all circumstances, however, the tape 22 and more particularly, the conductive wires 24 are maintained, spaced from and insulated electrically from the post 10.

Various alternative constructions may be utilized. For example, a single clamp may be used to attach the insulating bracket to a post. The size and position of the loops may be varied. The spacing and constructional configuration of the bar 50 and arms 52 and 54 may be altered. Thus, the invention is to be limited only by the following claims and equivalents thereof.

What is claimed is:

1. A mounting bracket assembly for supporting a conductive electrified tape used for fence enclosures on a T-cross section, metal fence post, said assembly comprising, in combination:

a bracket formed from a non-conductive material, said bracket including a vertical support bar, a first horizontal projecting arm from the support bar adjacent one end of the bar, a second horizontal projecting arm from the support bar adjacent the opposite end of the bar, said second arm projecting parallel to the first arm and spaced from the first arm;

a rod connecting the first and second projecting arms;

a loop supported on the rod, said loop pivotal about the rod, said loop configured to receive and hold conductive tape over the loop; and a clamp mechanism affixed to the vertical support bar of the bracket for attaching the vertical support bar to a T-cross section fence post.

2. The mounting bracket assembly of claim 1 wherein the clamp mechanism includes first and second spaced clamping hooks for fitting over the fence post and a fastener attached to the vertical support bar for engaging the fence post and biasing the clamping hooks against the post.

3. The mounting bracket assembly of claim 1 including at least two pivotal loops on the rod for receiving and holding conductive tape.

* * * * *